US007735337B2

(12) United States Patent
Nanasi

(10) Patent No.: US 7,735,337 B2
(45) Date of Patent: Jun. 15, 2010

(54) RING GUARD HAVING OFFSET ADJUSTABLE FLANGES

(75) Inventor: John Nanasi, 44 Burlews Ct., Hackensack, NJ (US) 07601

(73) Assignee: John Nanasi, Hackensack, NJ (US)

( * ) Notice: Subject to any disclaimer, the term of this patent is extended or adjusted under 35 U.S.C. 154(b) by 471 days.

(21) Appl. No.: 11/821,941

(22) Filed: Jun. 25, 2007

(65) Prior Publication Data

US 2008/0314082 A1 Dec. 25, 2008

(51) Int. Cl.
*A44C 9/02* (2006.01)

(52) U.S. Cl. ..... 63/15.6; 63/33

(58) Field of Classification Search ..... None
See application file for complete search history.

(56) References Cited

U.S. PATENT DOCUMENTS 1,481,297 A * 1/1924 McKellar ..... 63/15.6
4,569,211 A * 2/1986 Lodrini ..... 63/15.6

* cited by examiner

*Primary Examiner*—Jack W. Lavinder
(74) *Attorney, Agent, or Firm*—Ezra Sutton

(57) ABSTRACT

An arcuate-shaped ring guard for use in combination with a circular finger ring for reducing the interior circumference of the finger ring. The arcuate-shaped ring guard includes an arcuate ring reducer member being substantially crescent shaped. The ring reducer member includes an outer curved perimeter wall surface, and an interior wall surface, and opposing side wall surfaces for forming the ring reducer member. The arcuate-shaped ring guard further includes a pair of offset adjustable flange members that are attached to each of the opposing side wall surfaces of the ring reducer member in a spaced-apart and in an offset manner. Each of the offset adjustable flange members includes a first end and a second end. Each of the second ends of the offset adjustable flange members are placed adjacent to and in contact with the exterior band surface of the finger ring and are wrapped around the exterior band surface of the finger ring. The outer curved perimeter wall surface is placed adjacent to and in contact with the interior band surface of the finger ring. The interior wall surface is placed adjacent to and in contact with the skin on the under surface of the wearer's finger in order to provide a snug fit.

5 Claims, 4 Drawing Sheets

RING GUARD HAVING OFFSET ADJUSTABLE FLANGES

FIELD OF THE INVENTION

The present invention relates to an arcuate-shaped ring guard for reducing the diameter of a ring. More particularly, the arcuate-shaped ring guard includes offset adjustable flanges for attachably securing the ring guard to rings having different band thicknesses allowing the user to wear a larger ring over a smaller finger for a snug fit.

BACKGROUND OF THE INVENTION

Ring guards are well known in the prior art, as these ring guards, ring inserts, or ring sizers are placed on ring bands to reduce the size of a wearer's ring. Also, the ring guard secures the ring from movement along the wearer's finger. The wearing of a ring having an inside diameter larger than the diameter of the finger presents several problems: e.g. the ring can twist or rotate about the finger and thus be uncomfortable to the wearer and/or displayed in an unsightly manner, or the ring may become so loose that it may slip off the finger and become lost. Most ring guards solve the aforementioned problems which occur with over-sized finger rings. But not all ring guards are able to properly fit on a ring band having a larger band width or thickness than a normal engagement ring-type band thickness.

There remains a need for an arcuate-shaped ring guard having offset adjustable flanges for attachably securing the ring guard to various sized rings having different band thicknesses and allowing the user to wear a larger sized diameter finger ring over a smaller wearer's finger in order to obtain a snug fit on the wearer's finger. Additionally, there is a need for the offset adjustable flanges to be easily manipulated and bent to fit on the different sized band thicknesses.

DESCRIPTION OF THE PRIOR ART

Ring guards, ring inserts, ring sizers and the like having various designs, configurations, structures and materials of construction have been disclosed. For example, U.S. Pat. No. 5,628,208 to ROOD discloses a ring reducer for fitting a larger ring to an individual's smaller finger. The reducer includes a ring having a slot allowing a portion of a ring to be positioned within the conduit. A reducing web extends inward from the conduit to reduce the area of the ring and allow for the snug fit of a larger ring over a smaller finger. The reducer may be customized to a particular individual by trimming the reducing web with a knife. This prior art patent does not teach or disclose the design, configuration and structure of a ring guard having offset adjustable flanges for reducing a ring diameter size as claimed in the present invention.

U.S. Pat. No. 3,360,959 to SHECHTER et al. discloses an ornamental finger ring which is conventional except for the addition of a new and improved ring guard. The ring comprises a circular 360° sweep band and a setting for a precious gem or other suitable ornament. The ring guard is incorporated into the ornamental finger ring and has a generally arcuate upwardly concave sector which is swingably mounted in a circumferential slot I the ring band. The slot is diametrically opposed to the ring setting. The sector has an undulated surface which, when the ring is worn, bears against the soft flesh on the under surface of the wearer's finger. This prior art patent does not teach or disclose the design, configuration and structure of a ring guard having offset adjustable flanges for reducing a ring diameter size as claimed in the present invention.

None of the prior art references disclose or teach the structure and configuration of a ring guard having offset adjustable flanges for use with different band thicknesses allowing the wearer to reduce ring diameter size in order to allow the user to wear a larger size ring over a smaller finger for obtaining a snug fit.

Accordingly, it is an object of the present invention to provide an arcuate-shaped ring guard for reducing the diameter and circumference of a wearer's ring.

Another object of the present invention is to provide an arcuate-shaped ring guard having offset adjustable flanges for attachably securing the ring guard to rings having different band thicknesses in order to allow the user to wear a larger finger ring over a smaller finger for a snug fit.

Another object of the present invention is to provide an arcuate-shaped ring guard such that the offset adjustable flanges are easily manipulated and bent to fit on the different band thicknesses without any wearer discomfort when on the wearer's finger.

Another object of the present invention is to provide an arcuate-shaped ring guard having offset adjustable flanges that can be easily removed and detached from the wearer's ring.

Another object of the present invention is to provide an arcuate-shaped ring guard to be worn within the ring which minimally applies pressure against the soft flesh on the under surface of the wearer's finger.

Another object of the present invention is to provide an arcuate-shaped ring guard that is durable, easily cleaned and flexible for long wear.

A further object of the present invention is to provide an arcuate-shaped ring guard having offset adjustable flanges that can be mass-produced in an automated and economical manner and is readily affordable by the consumer.

SUMMARY OF THE INVENTION

In accordance with the present invention, there is provided arcuate-shaped ring guard for use in combination with a circular finger ring for reducing the interior circumference of the finger ring. The arcuate-shaped ring guard includes an arcuate ring reducer member being substantially crescent shaped. The ring reducer member includes an outer curved perimeter wall surface, and an interior wall surface, and opposing side wall surfaces for forming the ring reducer member. The arcuate-shaped ring guard further includes a pair of offset adjustable flange members that are attached to each of the opposing side wall surfaces of the ring reducer member in a spaced-apart and in an offset manner. Each of the offset adjustable flange members includes a first end and a second end. Each of the second ends of the offset adjustable flange members are placed adjacent to and in contact with the exterior band surface of the finger ring and are wrapped around the exterior band surface of the finger ring. The outer curved perimeter wall surface is placed adjacent to and in contact with the interior band surface of the finger ring. The interior wall surface is placed adjacent to and in contact with the skin on the under surface of the wearer's finger in order to provide a snug fit.

BRIEF DESCRIPTION OF THE DRAWINGS

Further objects, features, and advantages of the present invention will become apparent upon the consideration of the following detailed description of the presently-preferred embodiment when taken in conjunction with the accompanying drawings, wherein.

DETAILED DESCRIPTION OF THE EMBODIMENTS

Preferred Embodiment 10

The preferred embodiment of the present invention provides for an arcuate-shaped ring guard 10 having offset adjustable flanges 32 and 34 are represented in detail by FIGS. 1 through 6 of the patent drawings. The arcuate-shaped ring guard 10 is used for reducing the interior ring diameter D, of a ring 12.

Figure 1:
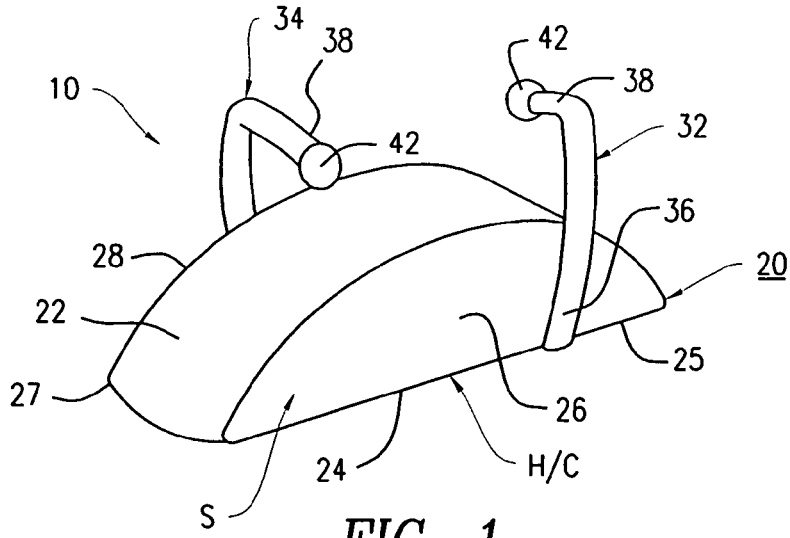
FIG. 1 is a perspective view of the arcuate-shaped ring guard of the preferred embodiment of the present invention showing a pair of offset adjustable flanges attached to sides of an arcuate ring reducer member for forming the arcuate-shaped ring guard.

As shown in FIG. 1, the arcuate-shaped ring guard 10 includes an arcuate ring reducer member 20, being substantially in the shape of a crescent or semi-circle S. The ring reducer member 20 includes an outer curved perimeter surface 22, an interior wall surface 24 and opposing side wall surfaces 26 and 28 for forming the ring reducer member 20. The interior wall surface 24 can have a flat horizontal surface H or a curved concave surface C for contacting with the soft flesh section/skin portion on the under surface 18 of the wearer's ring finger 16 in order to provide a snug fit. The arcuate-shaped ring guard 10 also includes a pair of offset adjustable flange members 32 and 34 attached to each opposing side wall 26 and 28 in a spaced-apart and in an offset manner (See FIG. 1) of the ring reducer member 20.

Figure 2:
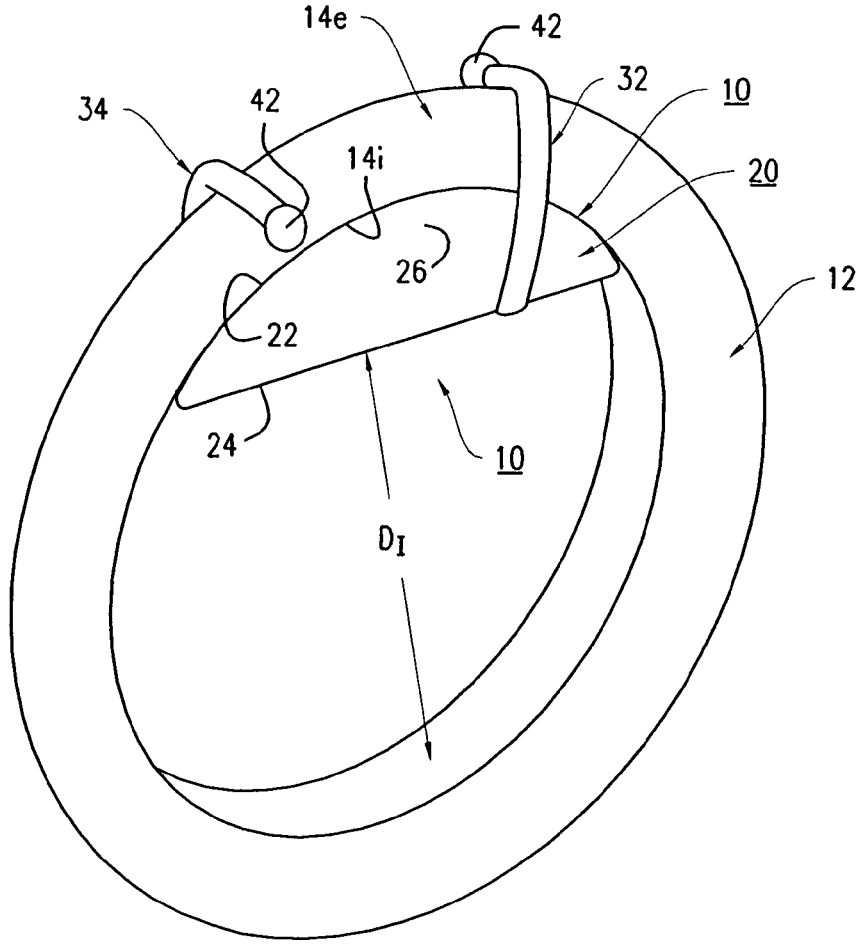
FIG. 2 is a bottom perspective view of the arcuate-shaped ring guard of the present invention showing the offset adjustable flanges wrapped around a band section of a ring having the arcuate ring reducer member reducing the diameter and circumference of the ring.
Figure 3:
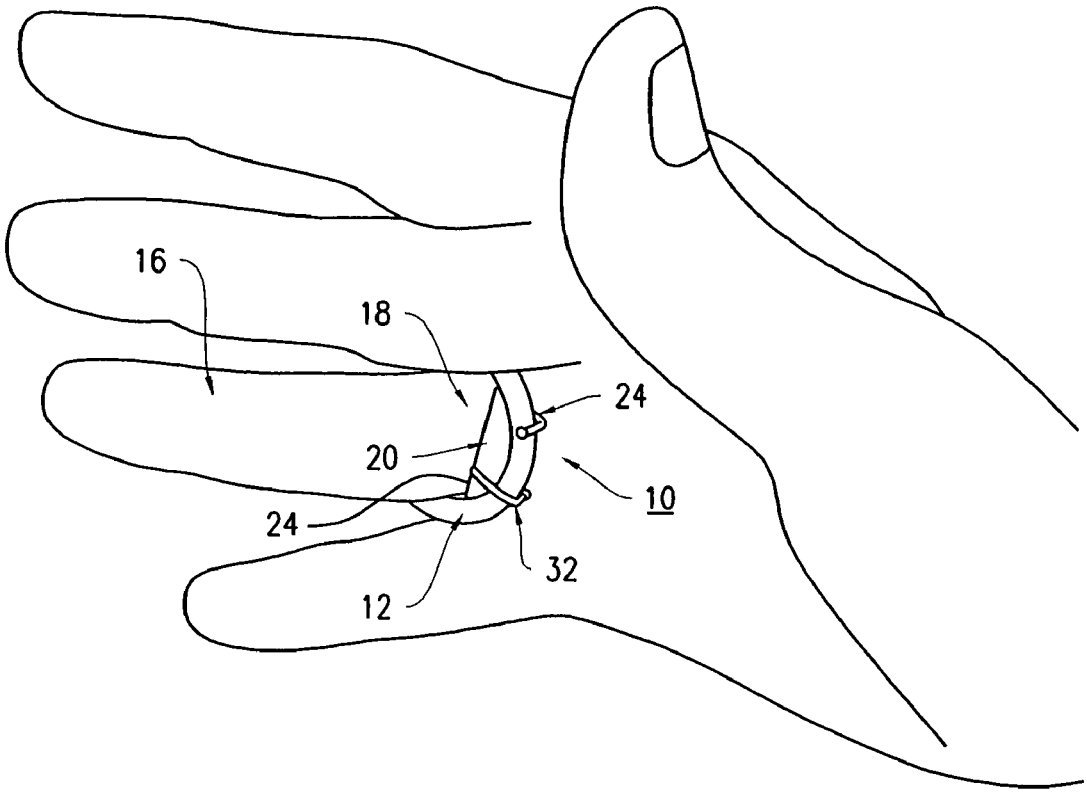
FIG. 3 is a perspective view of the arcuate-shaped ring guard of the present invention showing the ring guard in an assembled configuration and in an operational mode being worn on a finger of a wearer's hand.

Each of the offset adjustable flange members 32 and 34 includes a first end 36 and a second end 38. The first ends 36 of each flange member 32 and 34 are adjacent to interior perimeter edges 25 and 27 of the interior wall surface 24 of ring reducer member 20, as depicted in FIGS. 1 and 2 of the drawings. Each of the second ends 38 of flange members 32 and 34 includes a spherically-shaped holding tab member 42, as shown in FIGS. 1 and 2, for contacting and holding to an exterior band section 14*e* of ring 12 in an offset manner, such that the offset adjustable flange members 32 and 34 are wrapped around the exterior band section 14*e* of ring 12 in order to hold the outer curved perimeter surface 22 of the ring reducer member 20 against and in contact with an interior band section 14*i* of ring 12. The arcuate-shaped ring guard 10 is shown assembled and in place, and in a operational mode, as depicted in FIG. 3.

First Alternate Embodiment 100

Figure 4:
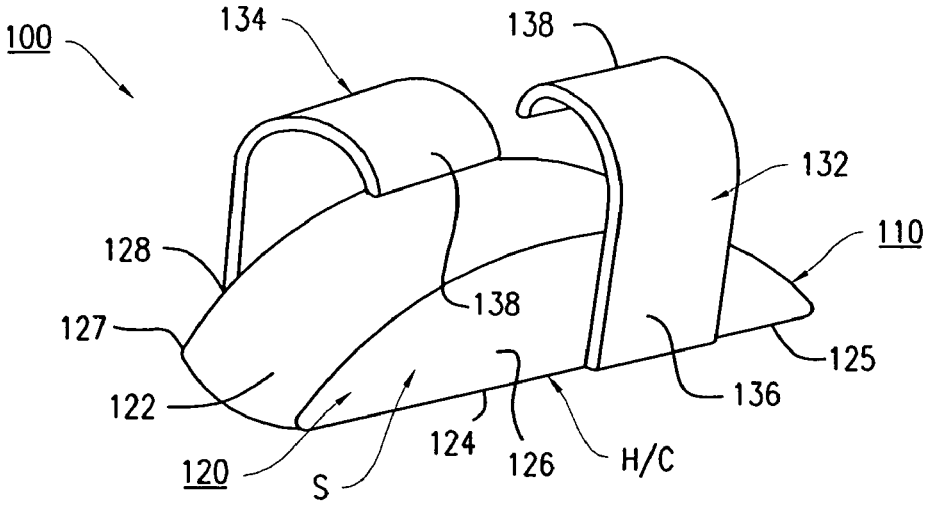
FIG. 4 is a perspective view of the arcuate-shaped ring guard of the first alternate embodiment of the present invention showing an alternate design of the offset adjustable flanges attached to sides of the arcuate ring reducer member for forming the arcuate-shaped ring guard.
Figure 5:
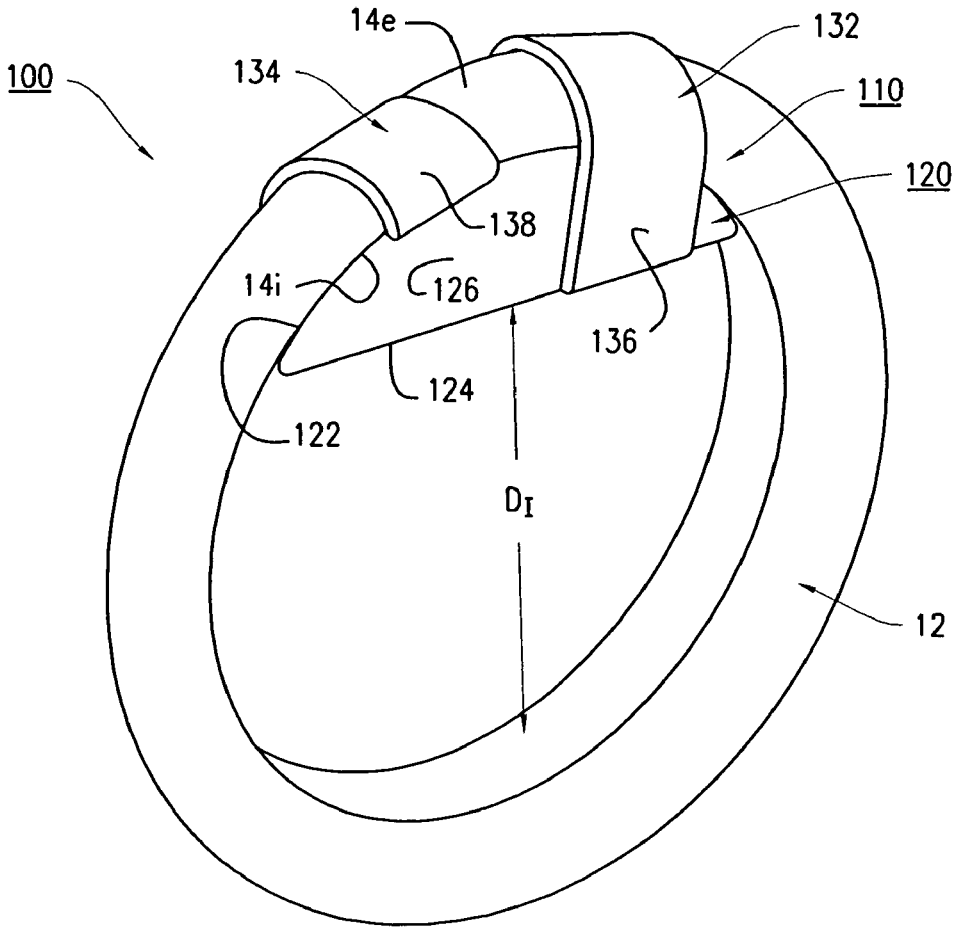
FIG. 5 is a bottom perspective view of the arcuate-shaped ring guard of the present invention showing the alternate offset adjustable flanges wrapped around a band section of a ring having the arcuate ring reducer member reducing the diameter and circumference of the ring.
Figure 6:
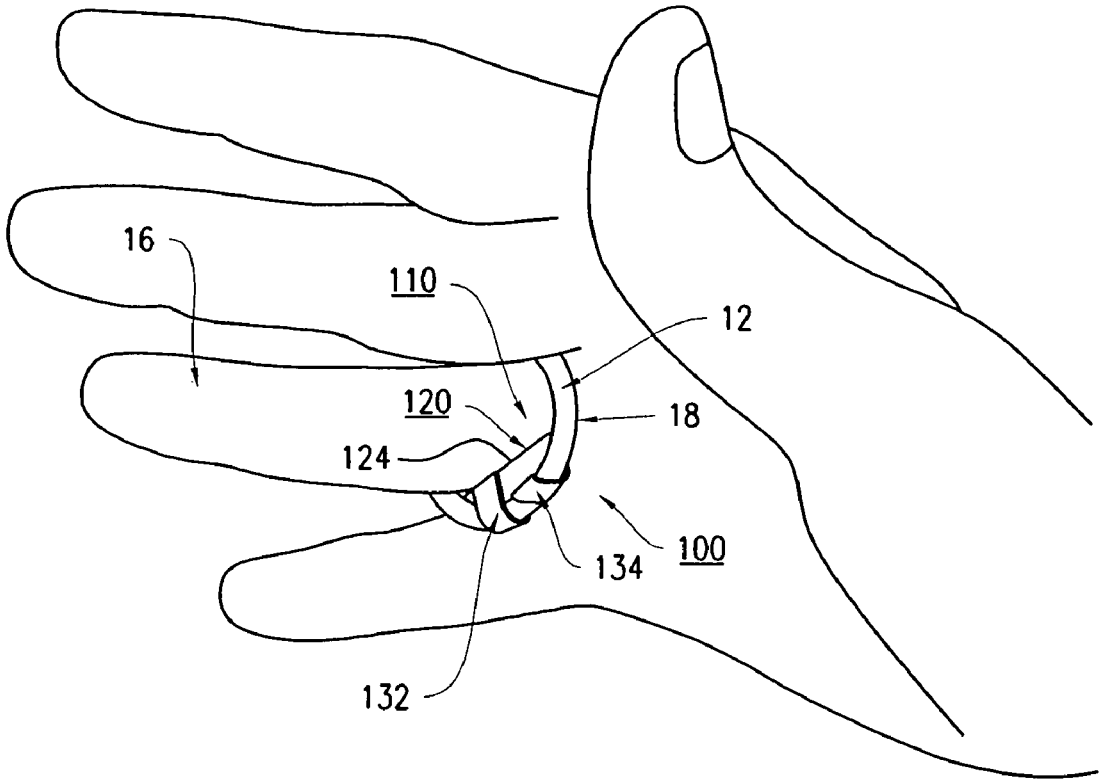
FIG. 6 is a perspective view of the arcuate-shaped ring guard of the present invention showing the ring guard in an assembled configuration and in an operational mode being worn on a finger of a wearer's hand.

The arcuate-shaped ring guard 110 of the first alternate embodiment of the present invention is represented in detail by FIGS. 4 through 6 of the patent drawings. Elements illustrated in FIGS. 4 and 5 which correspond to the elements described above with reference to FIGS. 1 through 3 have been designated by corresponding reference numbers increased by one hundred.

The first alternate embodiment 100 is similarly constructed and operates in the exactly same manner as the preferred embodiment 10, unless it is otherwise stated. All aspects of the first alternate embodiment of the arcuate-shaped ring guard 110 are the same as the preferred embodiment of the arcuate-shaped ring guard 10 except for the shape and configuration of each of the offset adjustable flange members 132 and 134 being substantially an L-shaped and flat structure (See FIGS. 1 and 2).

In all other respects, the arcuate-shaped ring guard 110 of the first alternate embodiment 100 is exactly the same as the arcuate-shaped ring guard of the preferred embodiment 10, except for the shape and configuration of each flat flange member 132 and 134 attached to each opposing side wall 126 and 128 on ring reducer member 120 in a spaced-apart and in an offset manner (See FIGS. 4 and 5).

It is understood that the arcuate-shaped ring guards 10 and 110 can be made of pliable and flexible metals such as silver, gold, platinum, stainless steel and the like.

Operation of the Present Invention

As shown in FIGS. 1 to 3, the arcuate-shaped ring guard 20 in conjunction with the finger ring 12 operates in the following manner: a jeweler or a user initially inserts and places the outer curved perimeter surface 22 of the ring reducer member 20 against and in contact with the interior band section 14*i* of ring 12. Then the jeweler or wearer bends each of the second ends 38 of the offset adjustable flange members 32 and 34 such that the spherical holding tab members 42 of each flange member 32 and 34 are in contact with the exterior surface of band section 14*e* of ring 12. In this manner each of the offset flange members 32 and 34 are wrapped around the exterior band section 14*e* of ring 12 in order to hold and keep the ring guard 10 in place. The arcuate-shaped ring guard 10 is in an assembled state and in an operational mode, as shown in FIG. 3.

It is also understood that the first alternate embodiment 100 of ring guard 110 operates in the exact same manner as the preferred embodiment 10.

Advantages of the Present Invention

Accordingly, an advantage of the present invention is that it provides for an arcuate-shaped ring guard for reducing the diameter and circumference of a wearer's ring.

Another advantage of the present invention is that it provides for an arcuate-shaped ring guard having offset adjustable flanges for attachably securing the ring guard to rings having different band thicknesses in order to allow the user to wear a larger finger ring over a smaller finger for a snug fit.

Another advantage of the present invention is that it provides for an arcuate-shaped ring guard such that the offset adjustable flanges are easily manipulated and bent to fit on the different band thicknesses without any wearer discomfort when on the wearer's finger.

Another advantage of the present invention is that it provides for an arcuate-shaped ring guard having offset adjustable flanges that can be easily removed and detached from the wearer's ring.

Another advantage of the present invention is that it provides for an arcuate-shaped ring guard to be worn within the ring which minimally applies pressure against the soft flesh on the under surface of the wearer's finger.

Another advantage of the present invention is that it provides for an arcuate-shaped ring guard that is durable, easily cleaned and flexible for long wear.

A further advantage of the present invention is that it provides for an arcuate-shaped ring guard having offset adjustable flanges that can be mass-produced in an automated and economical manner and is readily affordable by the consumer.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. An arcuate-shaped ring guard for use in combination with a circular finger ring for reducing the interior circumference of the finger ring, comprising:

a) an arcuate-shaped ring guard having an arcuate ring reducer member being substantially crescent shaped;

b) said ring reducer member including an outer curved perimeter wall surface, and an interior wall surface, and opposing side wall surfaces for forming said ring reducer member;

c) said arcuate-shaped ring guard further including a pair of offset adjustable flange members being attached to each of said opposing side wall surfaces of said ring reducer member in a spaced-apart and in an offset manner;

d) each of said offset adjustable flange members having a first end and a second end;

e) each of said second ends of said offset adjustable flange members are placed adjacent to and in contact with the exterior band surface of the finger ring and are wrapped around the exterior band surface of the finger ring;

f) said outer curved perimeter wall surface being placed adjacent to and in contact with the interior band surface of the finger ring;

g) said interior wall surface is placed adjacent to and in contact with the skin on the under surface of the wearer's finger in order to provide a snug fit; and h) wherein each of said second ends of said flange members includes a spherically-shaped holding tab member thereon for contacting and engaging the exterior band surface of the finger ring.

2. An arcuate-shaped ring guard in accordance with claim 1, wherein each of said first ends of said flange members are adjacent and attached to said opposing side wall surfaces of said ring reducer member.

3. An arcuate-shaped ring guard in accordance with claim 1, wherein each of said flange members are substantially L-shaped.

4. An arcuate-shaped ring guard in accordance with claim 1, wherein each of said flange members are substantially cylindrically-shaped rods.

5. An arcuate-shaped ring guard in accordance with claim 1, wherein each of said flange members are substantially flat-shaped bars.

* * * * *